US007303008B2

(12) United States Patent
Badalamenti et al.

(10) Patent No.: US 7,303,008 B2
(45) Date of Patent: Dec. 4, 2007

(54) METHODS AND SYSTEMS FOR REVERSE-CIRCULATION CEMENTING IN SUBTERRANEAN FORMATIONS

(75) Inventors: Anthony M. Badalamenti, Katy, TX (US); Karl W. Blanchard, Cypress, TX (US); Michael G. Crowder, Orlando, OK (US); Ronald R. Faul, Katy, TX (US); James E Griffith, Loco, OK (US); Henry E. Rogers, Duncan, OK (US); Simon Turton, Kingwood, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 303 days.

(21) Appl. No.: 10/973,322

(22) Filed: Oct. 26, 2004

(65) Prior Publication Data

US 2006/0086499 A1 Apr. 27, 2006

(51) Int. Cl.
*E21B 33/14* (2006.01)
*E21B 33/16* (2006.01)
*E21B 47/06* (2006.01)

(52) U.S. Cl. ..... 166/250.14; 166/117.4; 166/285; 166/291; 166/384; 73/152.51

(58) Field of Classification Search ..... 166/250.07, 166/250.14, 285, 290, 291, 384, 250.01, 166/177.4; 73/152.51
See application file for complete search history.

(56) References Cited

U.S. PATENT DOCUMENTS 2,223,509 A 12/1940 Brauer
2,230,589 A 2/1941 Driscoll
2,308,072 A * 1/1943 Granger ..... 166/290

(Continued)

FOREIGN PATENT DOCUMENTS

EP 0 419 281 A2 3/1991

(Continued)

OTHER PUBLICATIONS

Griffith, et al., "Reverse Circulation of Cement on Primary Jobs Increases Cement Column Height Across Weak Formations," Society of Petroleum Engineers, SPE 25440, 315-319, Mar. 22-23, 1993.

(Continued)

*Primary Examiner*—George Suchfield
(74) *Attorney, Agent, or Firm*—John W. Wustenberg; Baker Botts, L.L.P.

(57) ABSTRACT

Methods and systems for reverse-circulation cementing in subterranean formations are provided. An example of a method is a method of cementing casing in a subterranean well bore, comprising inserting a casing into the well bore, the casing comprising a casing shoe; equipping the casing with a well head, and a casing inner diameter pressure indicator; flowing an equilibrium fluid into the well bore; flowing a cement composition into the well bore after the equilibrium fluid; determining from the well-bore pressure indicator when the well bore pressure has reached a desired value; discontinuing the flow of cement composition into the well bore upon determining that the well bore pressure has reached a desired value; and permitting the cement composition to set in the subterranean formation. Examples of systems include systems for cementing casing in a well bore.

53 Claims, 7 Drawing Sheets

U.S. PATENT DOCUMENTS

| | | | | | |
|---|---|---|---|---|---|
| 2,407,010 | A | | 9/1946 | Hudson | |
| 2,472,466 | A | | 6/1949 | Counts et al. | |
| 2,647,727 | A | | 8/1953 | Edwards | 255/28 |
| 2,675,082 | A | | 4/1954 | Hall | |
| 2,849,213 | A | | 8/1958 | Failing | |
| 2,864,449 | A | * | 12/1958 | Tausch | 166/115 |
| 2,919,709 | A | | 1/1960 | Schwegman | 137/68 |
| 3,051,246 | A | | 8/1962 | Ckark, Jr. et al. | 166/226 |
| 3,116,793 | A | * | 1/1964 | McStravick | 166/285 |
| 3,193,010 | A | | 7/1965 | Bielstein | |
| 3,277,962 | A | | 10/1966 | Flickinger et al. | |
| 3,570,596 | A | | 3/1971 | Young | |
| 3,948,322 | A | | 4/1976 | Baker | 166/289 |
| 3,948,588 | A | | 4/1976 | Curington et al. | |
| 3,951,208 | A | | 4/1976 | Delano | 166/78 |
| 4,105,069 | A | | 8/1978 | Baker | 166/51 |
| 4,271,916 | A | | 6/1981 | Williams | |
| 4,300,633 | A | | 11/1981 | Stewart | 166/250 |
| 4,304,298 | A | | 12/1981 | Sutton | |
| 4,340,427 | A | | 7/1982 | Sutton | |
| 4,367,093 | A | | 1/1983 | Burkhalter et al. | |
| RE31,190 | E | | 3/1983 | Detroit et al. | 166/293 |
| 4,423,781 | A | * | 1/1984 | Thomas | 166/312 |
| 4,450,010 | A | | 5/1984 | Burkhalter et al. | |
| 4,457,379 | A | | 7/1984 | McStravick | |
| 4,469,174 | A | | 9/1984 | Freeman | |
| 4,519,452 | A | | 5/1985 | Tsao et al. | |
| 4,531,583 | A | | 7/1985 | Revett | 166/253 |
| 4,548,271 | A | | 10/1985 | Keller | 166/291 |
| 4,555,269 | A | | 11/1985 | Rao et al. | 525/130 |
| 4,565,578 | A | | 1/1986 | Sutton et al. | |
| 4,671,356 | A | | 6/1987 | Barker et al. | |
| 4,676,832 | A | | 6/1987 | Childs et al. | 106/730 |
| 4,729,432 | A | | 3/1988 | Helms | |
| 4,791,988 | A | | 12/1988 | Trevillion | |
| 4,961,465 | A | | 10/1990 | Brandell | |
| 5,024,273 | A | | 6/1991 | Coone et al. | 166/289 |
| 5,117,910 | A | | 6/1992 | Brandell et al. | |
| 5,125,455 | A | | 6/1992 | Harris et al. | |
| 5,133,409 | A | | 7/1992 | Bour et al. | 166/293 |
| 5,147,565 | A | | 9/1992 | Bour et al. | |
| 5,188,176 | A | | 2/1993 | Carpenter | 166/285 |
| 5,213,161 | A | | 5/1993 | King et al. | |
| 5,273,112 | A | | 12/1993 | Schultz | |
| 5,297,634 | A | | 3/1994 | Loughlin | 166/387 |
| 5,318,118 | A | | 6/1994 | Duell | |
| 5,323,858 | A | | 6/1994 | Jones et al. | |
| 5,361,842 | A | | 11/1994 | Hale et al. | |
| 5,458,198 | A | * | 10/1995 | Hashemi et al. | 166/312 |
| 5,484,019 | A | | 1/1996 | Griffith | |
| 5,494,107 | A | | 2/1996 | Bode | 166/285 |
| 5,507,345 | A | | 4/1996 | Wehunt, Jr. et al. | 166/285 |
| 5,559,086 | A | | 9/1996 | Dewprashad et al. | |
| 5,571,281 | A | | 11/1996 | Allen | |
| 5,577,865 | A | | 11/1996 | Manrique et al. | |
| 5,641,021 | A | | 6/1997 | Murray et al. | |
| 5,647,434 | A | | 7/1997 | Sullaway et al. | |
| 5,671,809 | A | | 9/1997 | McKinzie | |
| 5,718,292 | A | | 2/1998 | Heathman et al. | |
| 5,738,171 | A | | 4/1998 | Szarka | |
| 5,749,418 | A | | 5/1998 | Mehta et al. | |
| 5,762,139 | A | | 6/1998 | Sullaway et al. | 166/291 |
| 5,803,168 | A | | 9/1998 | Lormand et al. | |
| 5,829,526 | A | | 11/1998 | Rogers et al. | |
| 5,875,844 | A | | 3/1999 | Chatterji et al. | |
| 5,890,538 | A | | 4/1999 | Beirute et al. | 166/285 |
| 5,897,699 | A | | 4/1999 | Chatterji et al. | 106/678 |
| 5,900,053 | A | | 5/1999 | Brothers et al. | |
| 5,913,364 | A | | 6/1999 | Sweatman | |
| 5,968,255 | A | | 10/1999 | Mehta et al. | |
| 5,972,103 | A | | 10/1999 | Mehta et al. | |
| 6,060,434 | A | | 5/2000 | Sweatman et al. | |
| 6,063,738 | A | | 5/2000 | Chatterji et al. | 507/269 |
| 6,098,710 | A | | 8/2000 | Rhein-Knudsen et al. | 166/285 |
| 6,138,759 | A | | 10/2000 | Chatterji et al. | 166/293 |
| 6,143,069 | A | | 11/2000 | Brothers et al. | |
| 6,167,967 | B1 | | 1/2001 | Sweatman | |
| 6,196,311 | B1 | | 3/2001 | Treece | 166/192 |
| 6,204,214 | B1 | | 3/2001 | Singh et al. | |
| 6,244,342 | B1 | | 6/2001 | Sullaway et al. | 166/285 |
| 6,258,757 | B1 | | 7/2001 | Sweatman et al. | |
| 6,311,775 | B1 | | 11/2001 | Allamon et al. | 166/285 |
| 6,318,472 | B1 | | 11/2001 | Rogers et al. | |
| 6,367,550 | B1 | | 4/2002 | Chatterji et al. | 166/293 |
| 6,431,282 | B1 | | 8/2002 | Bosma et al. | |
| 6,454,001 | B1 | | 9/2002 | Thompson et al. | |
| 6,457,524 | B1 | | 10/2002 | Roddy | |
| 6,467,546 | B2 | | 10/2002 | Allamon et al. | 166/381 |
| 6,481,494 | B1 | | 11/2002 | Dusterhoft et al. | 166/51 |
| 6,484,804 | B2 | | 11/2002 | Allamon et al. | 166/291 |
| 6,488,088 | B1 | | 12/2002 | Kohli et al. | 166/285 |
| 6,488,089 | B1 | | 12/2002 | Bour et al. | |
| 6,488,763 | B2 | | 12/2002 | Brothers et al. | |
| 6,540,022 | B2 | | 4/2003 | Dusterhoft et al. | 166/278 |
| 6,622,798 | B1 | | 9/2003 | Rogers et al. | |
| 6,666,266 | B2 | | 12/2003 | Starr et al. | |
| 6,679,336 | B2 | | 1/2004 | Musselwhite et al. | |
| 6,712,150 | B1 | * | 3/2004 | Misselbrook et al. | 166/384 |
| 6,715,553 | B2 | | 4/2004 | Reddy et al. | |
| 6,722,434 | B2 | | 4/2004 | Reddy et al. | |
| 6,725,935 | B2 | | 4/2004 | Szarka et al. | |
| 6,732,797 | B1 | | 5/2004 | Watters et al. | 166/291 |
| 6,758,281 | B2 | | 7/2004 | Sullaway et al. | |
| 6,802,374 | B2 | | 10/2004 | Edgar et al. | |
| 6,808,024 | B2 | | 10/2004 | Schwendemann et al. | |
| 6,810,958 | B2 | | 11/2004 | Szarka et al. | |
| 2002/0148614 | A1 | | 10/2002 | Szarka | |
| 2003/0000704 | A1 | | 1/2003 | Reynolds | 166/312 |
| 2003/0029611 | A1 | | 2/2003 | Owens | 166/250.03 |
| 2003/0072208 | A1 | | 4/2003 | Rondeau et al. | |
| 2003/0192695 | A1 | | 10/2003 | Dillenbeck et al. | 166/285 |
| 2004/0079553 | A1 | | 4/2004 | Livingstone | 175/61 |
| 2004/0084182 | A1 | | 5/2004 | Edgar et al. | 166/285 |
| 2004/0099413 | A1 | | 5/2004 | Arceneaux | 166/173 |
| 2004/0104050 | A1 | | 6/2004 | Järvelä et al. | 175/57 |
| 2004/0104052 | A1 | | 6/2004 | Livingstone | 175/61 |
| 2004/0177962 | A1 | | 9/2004 | Bour | 166/285 |
| 2004/0231846 | A1 | | 11/2004 | Griffith et al. | |
| 2005/0061546 | A1 | | 3/2005 | Hannegan | 175/7 |
| 2006/0016599 | A1 | | 1/2006 | Badalamenti et al. | |
| 2006/0016600 | A1 | | 1/2006 | Badalamenti et al. | |
| 2006/0042798 | A1 | | 3/2006 | Badalamenti et al. | |
| 2006/0086502 | A1 | | 4/2006 | Reddy et al. | |
| 2006/0086503 | A1 | | 4/2006 | Reddy et al. | |
| 2006/0131018 | A1 | | 6/2006 | Rogers et al. | |

FOREIGN PATENT DOCUMENTS

| | | | |
|---|---|---|---|
| GB | 2193741 | | 2/1988 |
| GB | 2327442 | A | 1/1999 |
| GB | 2348828 | A | 10/2000 |
| RU | 1774986 | | 11/1992 |
| RU | 1778274 | | 11/1992 |
| RU | 1542143 | C | 12/1994 |
| RU | 2067158 | | 9/1996 |
| RU | 2 086 752 | C1 | 8/1997 |
| SU | 1420139 | A1 | 8/1988 |
| SU | 1716096 | | 2/1992 |
| SU | 1723309 | A1 | 2/1992 |
| SU | 1723309 | | 3/1992 |
| SU | 1758211 | A1 | 8/1992 |
| SU | 1716096 | A1 | 9/2005 |
| WO | WO 2006/008490 | A1 | 3/1992 |
| WO | WO 2004/104366 | | 12/2004 |

| | | | |
|---|---|---|---|
| WO | WO 2005/083229 | | 9/2005 |
| WO | WO 2005/083229 | A | 9/2005 |
| WO | WO 2006/008490 | | 1/2006 |
| WO | WO 2006/064184 | A1 | 1/2006 |
| WO | WO 2006/064184 | | 6/2006 |

OTHER PUBLICATIONS

Flippov, et al., "Expandable Tubular Solutions," Society of Petroleum Engineers, SPE 56500, Oct. 3-6, 1999.
Daigle et al., "Expandable Tubulars: Field Examples of Application in Well Construction and Remediation," Society of Petroleum Engineers, SPE 62958, Oct. 1-4, 2000.
Carpenter, et al., "Remediating Sustained Casing Pressure by Forming a Downhole Annular Seal With Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Fryer, "Evaluation of the Effects of Multiples in Seismic Data From the Gulf Using Vertical Seimic Profiles," SPE 25540, 1993.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al., "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficency Hollow Pusher Housing".
Abstract No. XP-02283583, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999
Dupal, et al, "Solid Expandable Tubular Techology—A Year of Case Histories in the Drilling Environment," SPE/IADC 67770, Feb. 27-Mar. 1, 2001.
DeMong, et al., "Planning the Well Construction Process for the Use of Solid Expandable Casing,"SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Relability in a Myriad of Downhole Environments," SPE 81094, Apr. 27-30, 2003.
Foreign communication from related counter part application dated Dec. 7, 2005.
Foreign Communication From a Related Counter Part Application, Oct. 12, 2005.
Foreign Communication From a Related Counter Part Application, Sep. 30, 2005.
Halliburton Brochure Entitled "Bentonite (Halliburton Gel) Viscosifer", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing Flex-Plug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the Stratalock Stabilization System", 1998.
Halliburton Brochure Entitled "Perlite Cement Additive", 1999.
Halliburton Brochure Entitled "The Permseal System Versatile, Cost-Effective Sealants for Conformance Applications", 2002.
Halliburton Brochure Entitled "Pozmix® Cement Additive", 1999.
Foreign Communication From a Related Counter Part Application, Dec. 9, 2005.
Foreign Communication From a Related Counter Part Application, Feb. 24, 2005.
R. Marquaire et al., "Primary Cementing by Reverse Circulation Solves Critical Problem in the North Hassi-Messaoud Field, Algeria", SPE 1111, Feb. 1966.
Foreign Communication From a Related Counter Part Application, Dec. 27, 2005.
Foreign Communication From a Related Counter Part Application, Feb. 23, 2006.
Foreign communication from a related counterpart application, Feb. 27, 2007.
Foreign communication from a related counterpart application, Jan. 8, 2007.
Foreign communication from a related counterpart application, Jan. 17, 2007.
Foreign Communication From a Related Counter Part Application, Jan. 8, 2007.
Foreign Communication From a Related Counter Part Application, Jan. 17, 2007.

* cited by examiner

METHODS AND SYSTEMS FOR REVERSE-CIRCULATION CEMENTING IN SUBTERRANEAN FORMATIONS

BACKGROUND OF THE PRESENT INVENTION

The present invention relates to subterranean cementing operations, and more particularly, to methods and systems for reverse-circulation cementing in subterranean formations.

Hydraulic cement compositions commonly are utilized in subterranean operations, particularly subterranean well completion and remedial operations. For example, hydraulic cement compositions are used in primary cementing operations whereby pipe strings, such as casings and liners, are cemented in well bores. In performing primary cementing, hydraulic cement compositions commonly are pumped into an annular space between the walls of a well bore and the exterior surface of a pipe string disposed therein. The cement composition is permitted to set in the annular space, thereby forming therein an annular sheath of hardened, substantially impermeable cement that substantially supports and positions the pipe string in the well bore, and that bonds the exterior surface of the pipe string to the walls of the well bore. Conventionally, two pumping methods have been used to place the cement composition in the annulus. First, the cement composition may be pumped down the inner diameter of the pipe string, out through a casing shoe and/or circulation valve at the bottom of the pipe string, and up through the annulus to a desired location. The direction in which the cement composition is pumped in this first method is called a conventional-circulation direction. Second, the cement composition may be pumped directly down the annulus, thereby displacing any well fluids present in the annulus by pushing them through the casing shoe and up the inner diameter of the pipe string. The direction in which the cement composition is pumped in this second method is called a reverse-circulation direction.

In reverse-circulation direction applications, it is sometimes undesirable for the cement composition to enter the inner diameter of the pipe string from the annulus through the casing shoe and/or circulation valve. For example, if an excessive volume of cement composition is permitted to enter the inner diameter of the pipe string, the cement composition may rise to a level equal to that of a hydrocarbon-bearing zone intended to be perforated. This may be problematic because it may prevent the subsequent placement of tools (e.g., perforating equipment) adjacent the hydrocarbon-bearing zone, which may prevent the perforation of the zone and subsequent production of hydrocarbons therefrom, unless the excess cement is drilled out. Accordingly, whenever a cement composition that is reverse-circulated into a subterranean annulus enters the inner diameter of the pipe string, the excess cement composition in the pipe string typically is drilled out before further operations are conducted. The drill-out procedure often requires additional time, labor, and expense that may be avoided by preventing the excess cement composition from entering the inner diameter of the pipe string through the casing shoe and/or circulation valve.

SUMMARY OF THE PRESENT INVENTION

The present invention relates to subterranean cementing operations, and more particularly, to methods and systems for reverse-circulation cementing in subterranean formations.

An example of a method of the present invention is a method of cementing casing in a well bore, comprising: inserting a casing into the well bore, the casing having an inner diameter and an outer surface, an annulus being defined between the outer surface of the casing and an inner wall of the well bore; flowing an equilibrium fluid into the well bore; flowing a cement composition into the well bore after flowing the equilibrium fluid into the well bore; permitting the pressure in the annulus to reach equilibrium with the pressure in the inner diameter of the casing, such that flow of cement composition into the well bore ceases; and permitting the cement composition to set in the well bore.

Another example of a method of the present invention is a method of cementing casing in a well bore, comprising: inserting a casing into the well bore, the casing having an inner diameter and an outer surface, an annulus being defined between the outer surface of the casing and an inner wall of the well bore; flowing an equilibrium fluid into the well bore; flowing a cement composition into the well bore after flowing the equilibrium fluid into the well bore; monitoring the pressure in the inner diameter of the casing; discontinuing the flow of cement composition into the well bore upon determining that the pressure in the inner diameter of the casing has reached a desired value; and permitting the cement composition to set in the well bore.

Another example of a method of the present invention is a method of cementing casing in a well bore, comprising: inserting casing into the well bore; flowing a circulation fluid into the well bore; flowing a marker into the well bore at a desired time during the flowing of the circulation fluid into the well bore; determining when the marker reaches a desired location; monitoring a volume of circulation fluid after flowing the marker into the well bore, and before determining when the marker reaches a desired location; determining a volume of cement composition to be flowed into the well bore; flowing the determined volume of cement composition into the well bore; and permitting the cement composition to set in the well bore.

Another example of a method of the present invention is a method of cementing casing in a well bore, comprising: inserting casing into the well bore; flowing a volume of circulation fluid, comprising a marker, into the well bore, the volume of circulation fluid being about equal to an inside volume of the casing; flowing a cement composition into the well bore after flowing the volume of circulation fluid; determining when the marker reaches a desired location; discontinuing flowing the cement composition into the well bore; and permitting the cement composition to set in the well bore.

An example of a system of the present invention is a system for cementing casing in a well bore comprising: a casing inserted into the well bore and defining an annulus therebetween; a cement composition for flowing into at least a portion of the annulus; and an equilibrium fluid that is positioned within the inner diameter of the casing and balances the static fluid pressures between the inner diameter of the casing and the annulus.

Another example of a system of the present invention is a system for cementing casing in a well bore comprising: a casing inserted into the well bore and defining an annulus therebetween, the casing having an inner diameter; a circulation fluid for flowing into the well bore, the circulation fluid having a leading edge that comprises a marker, and having a trailing edge, wherein the flow of the circulation fluid and marker into the well bore facilitates determination of a volume of cement composition sufficient to fill a desired portion of the annulus; a cement composition for flowing into at least a portion of the annulus, the cement composition having a leading edge in fluid communication with the trailing edge of the circulation fluid; and a marker detector in fluid communication with fluid passing through the inner diameter of the casing.

The features and advantages of the present invention will be readily apparent to those skilled in the art upon a reading of the description of embodiments, which follows.

BRIEF DESCRIPTION OF THE DRAWINGS

A more complete understanding of the present disclosure and advantages thereof may be acquired by referring to the following description taken in conjunction with the accompanying drawings, wherein.

Figure 1:
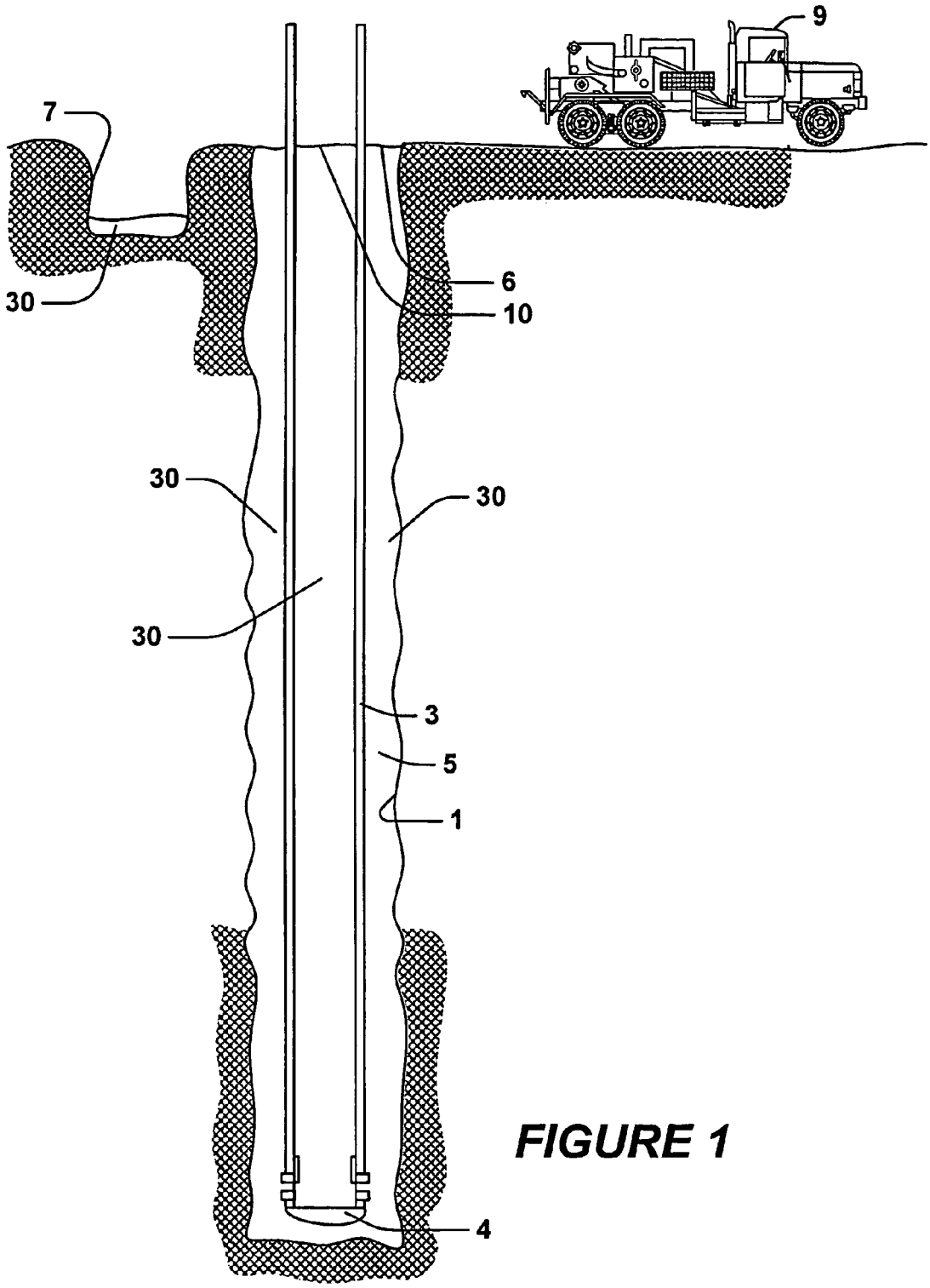
FIG. 1 illustrates a cross-sectional side view of a well bore and casing.

While the present invention is susceptible to various modifications and alternative forms, specific embodiments thereof have been shown in the drawings and are herein described. It should be understood, however, that the description herein of specific embodiments is not intended to limit the invention to the particular forms disclosed, but on the contrary, the intention is to cover all modifications, equivalents, and alternatives falling within the spirit and scope of the present invention as defined by the appended claims.

DETAILED DESCRIPTION OF EMBODIMENTS

The present invention relates to subterranean cementing operations, and more particularly, to methods and systems for reverse-circulation cementing in subterranean formations. Generally, any cement compositions suitable for use in subterranean applications may be suitable for use in the present invention.

Referring to FIG. 1, a cross-sectional side view of a well bore is shown. Well bore 1 is an open well bore with casing 3 inserted therein. Annulus 5 is defined between casing 3 and well bore 1. Casing 3 has casing shoe 4 at its lowermost end and simply extends from the open well bore at the top. Reservoir 7 is located proximate to well bore 1. Truck 9 is parked in the vicinity of well bore 1. Circulation fluid 30 is present within well bore 1 such that annular fluid surface 6 is approximately level with inner diameter fluid surface 10. In certain embodiments of the present invention, circulation fluid 30 that initially is present within well bore 1 may be a drilling fluid. FIG. 1 represents a typical well bore configuration prior to a cementing operation.

One aspect of the present invention provides a method for pumping a cement composition into annulus 5 without permitting excessive flow of cement composition into the inside diameter of casing 3. In certain embodiments wherein the interior volume of casing 3 has not been calculated, a first step of the method may involve calculating the interior volume of casing 3. The interior volume of casing 3 equals the product of $\pi$ multiplied by the square of the inside radius "r" of casing 3, multiplied by the length "h" of casing 3, as illustrated below:

$$V=\pi r^2 h \qquad \text{EQUATION 1}$$

Next, equilibrium fluid 11 (not shown in FIG. 1) may be selected having a density equal to the density of cement composition 15 (not shown in FIG. 1) that will be used to cement casing 3 in well bore 1. Generally, equilibrium fluid 11 may comprise any fluid (e.g., a drilling fluid, a spacer fluid, or the like) having a desired density (e.g., a density greater than the density of circulation fluid 30), provided that the fluid is compatible with both circulation fluid 30 and cement composition 15. Examples of suitable spacer fluids are commercially available from Halliburton Energy Services, Inc., of Duncan, Okla., under the trade names "TUNED SPACER," and "DUAL SPACER." Equilibrium fluid 11 then may be pumped ahead of cement composition 15 into annulus 5 and into well bore 1 in a reverse-circulation direction. Equilibrium fluid 11 may travel down annulus 5, through casing shoe 4 and up through the inner diameter of casing 3. When equilibrium fluid 11 completely fills the inside of casing 3, cement composition 15 flowing behind equilibrium fluid 11 will completely fill annulus 5, and the static fluid pressure of equilibrium fluid 11 will balance the static fluid pressure of cement composition 15, such that the flow of cement composition 15 into annulus 5 may cease. In particular, annular fluid surface 6 (e.g., the surface of cement composition 15 in the annulus) will be approximately level with inner diameter fluid surface 10 (e.g., the surface of equilibrium fluid 11 in well bore 1). Generally, the leading edge of cement composition 15 will be at about adjacent the lowermost end of casing 3 when the flow of cement composition 15 into the annulus ceases. Generally, the leading edge of cement composition 15 will not penetrate the inner diameter of casing 3.

In certain embodiments of the present invention, an operator may elect to fill less than the entire annulus 5 with cement composition 15. For example, this may be desirable when casing 3 comprises an intermediate casing string (e.g., a casing string having a depth of 10,000 feet, for example). In certain of these embodiments, an operator may determine an annular volume that is desired to be filled with cement composition 15 (e.g., a volume that is less than the total annular volume), and may determine a desired volume of equilibrium fluid 11 to be placed ahead of the desired volume of cement composition 15. For example, if casing 3 comprises an intermediate casing string having a depth of 10,000 feet, for example, the operator may determine that the lower 2,500 feet should be filled with cement composition 15. In such example, the volume of equilibrium fluid 11 that is to be placed ahead of cement composition 15 may be calculated such that it fills an equivalent height within casing 3 (e.g., 2,500 feet in this example wherein the density of equilibrium fluid equals the density of cement composition 15), and thus the uppermost height of equilibrium fluid 11 and the uppermost height of cement composition 15 would equal each other below the surface (e.g., 7,500 feet below the surface, in this example). Generally, in these embodiments wherein less than the entire annulus 5 may be filled with cement composition 15, the remaining volume of annulus 5 would comprise a fluid (e.g., a drilling fluid, spacer fluid, or equilibrium fluid 11, or the like) above cement composition 15 that is compatible with cement composition 15 and that has about the same, or greater, density as circulation fluid 30, thereby providing approximately equal hydrostatic pressures on both sides of casing 3. Of course, other combinations of fluid lengths and densities may exist where the density of equilibrium fluid 11 differs from the density of cement composition 15. Generally, the resultant hydrostatic pressure of the fluids placed in the formation ahead of cement composition 15, which fill the inside of casing 3, will approximately equal the resultant hydrostatic pressure of the fluids within annulus 5, including, inter alia, cement composition 15.

Figure 2A:
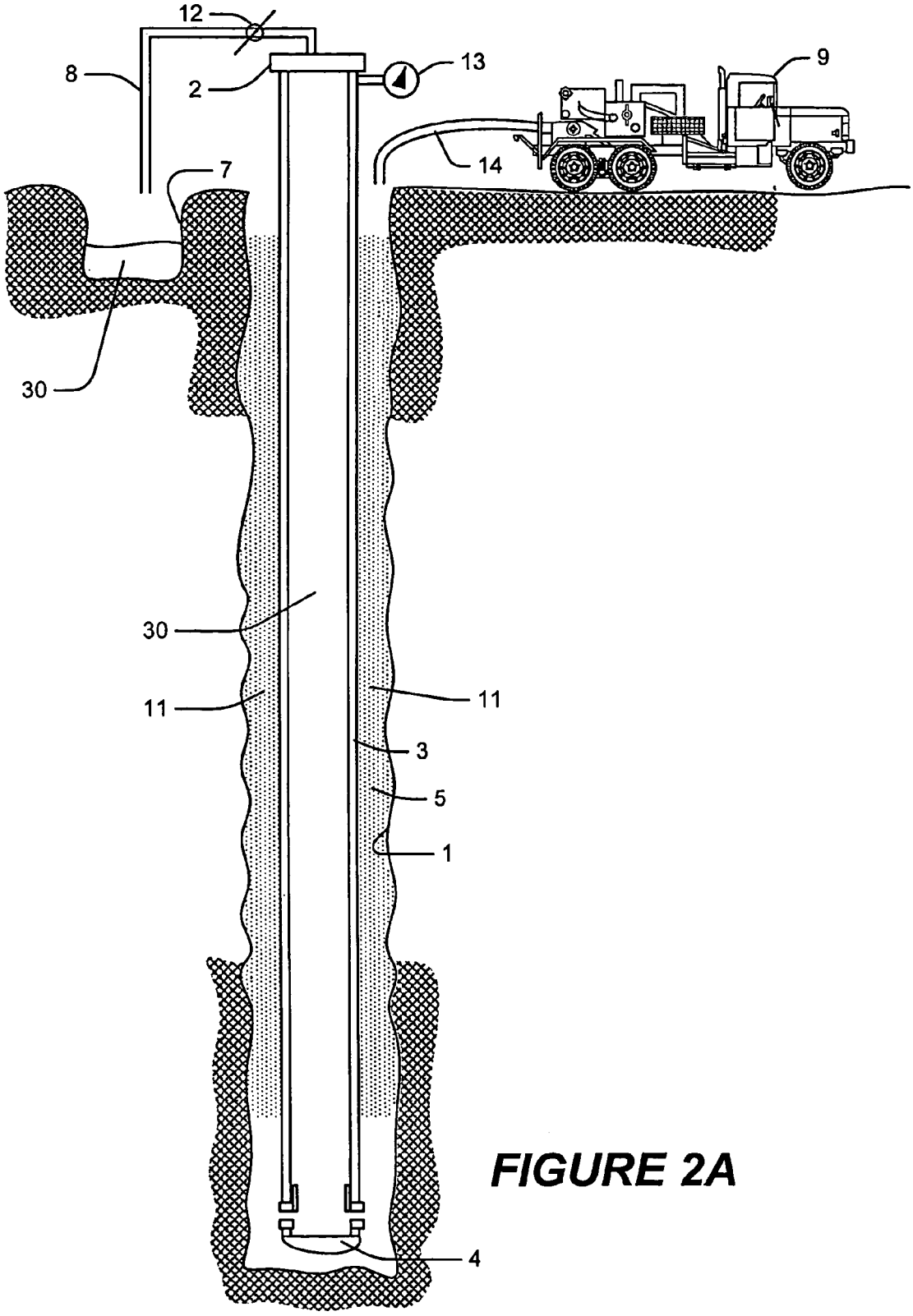
FIG. 2A illustrates a cross-sectional side view of a well bore and casing.
Figure 2B:
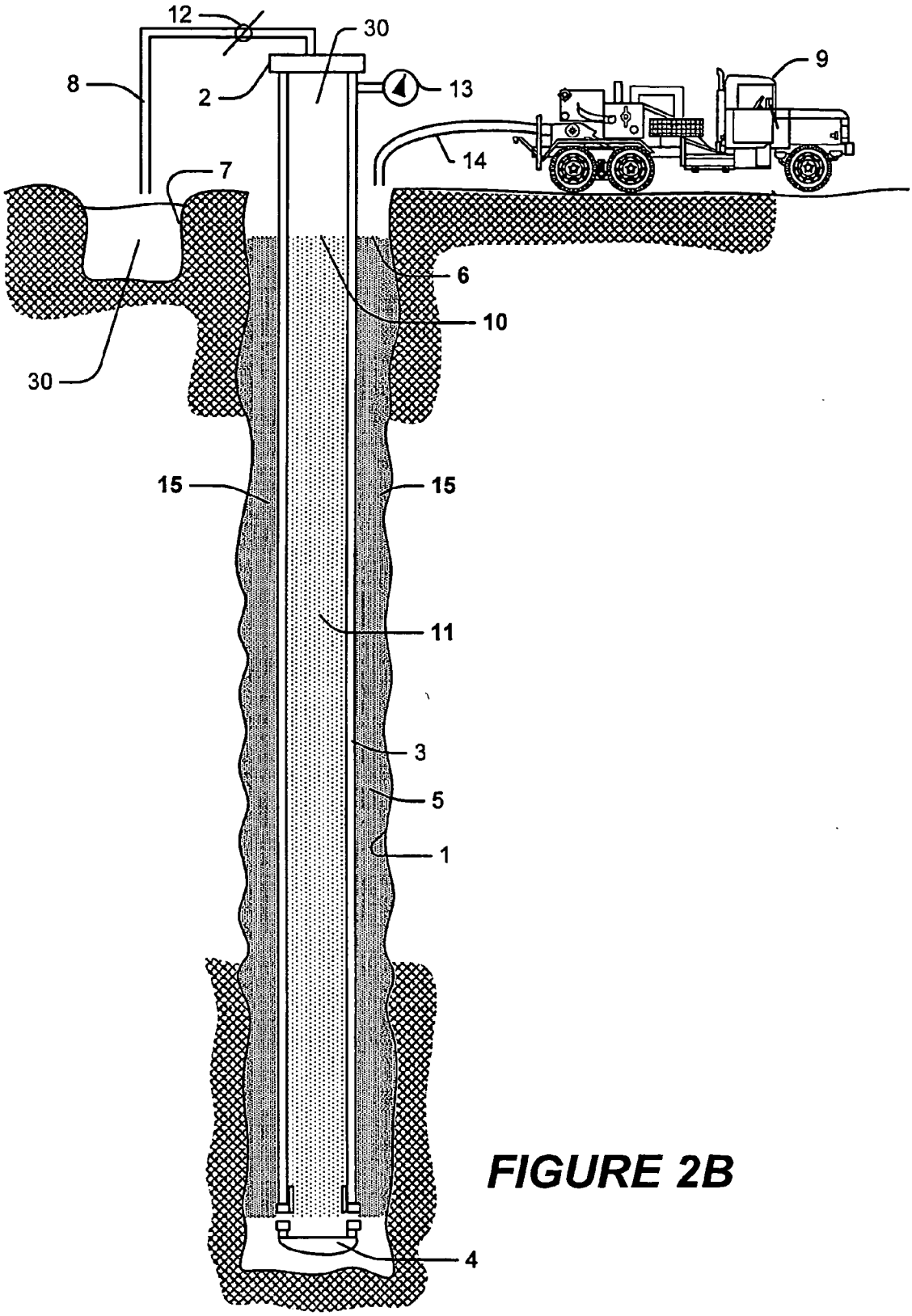
FIG. 2B illustrates a cross-sectional side view of the well bore and casing illustrated in FIG. 2A.

Referring to FIGS. 2A and 2B, cross-sectional side views of a well bore and casing are shown. The well bore configuration generally is similar to that previously described with reference to FIG. 1, though additional features are illustrated in FIGS. 2A and 2B. Well head 2 is attached to the exposed end of casing 3. Return line 8 extends from well head 2 to reservoir 7, and is in fluid communication with the inner diameter of casing 3. Return valve 12 is connected in return line 8. In certain embodiments of the present invention, return valve 12 may be a ball valve, a gate valve, a plug valve, or the like. An example of a suitable plug valve is commercially available from Halliburton Energy Services, Inc., of Duncan, Okla., under the trade name "LO-TORC." Pressure indicator 13 is attached to casing 3, and indicates the pressure within casing 3 below well head 2. Supply line 14 is connected to truck 9 for pumping fluids into annulus 5. As shown in FIG. 2A, the calculated volume of equilibrium fluid 11 has been pumped into annulus 5, thereby displacing a portion of circulation fluid 30 from annulus 5 into reservoir 7. Because equilibrium fluid 11 is intended only to fill the inside diameter of casing 3, annulus 5 may not be completely filled with equilibrium fluid 11 at this stage of the process, or it may spill over into the inside diameter of casing 3 through casing shoe 4. Once the calculated volume of equilibrium fluid 11 (e.g., a volume of equilibrium fluid 11 sufficient to fill the interior volume of casing 3) is pumped into annulus 5, cement composition 15 then may be pumped into annulus 5 behind equilibrium fluid 11.

As shown in FIG. 2B, cement composition 15 generally may be pumped down annulus 5 so as to drive equilibrium fluid 11 through casing shoe 4 and up through an inner diameter of casing 3. Because the density of both equilibrium fluid 11 and cement composition 15 exceeds the density of circulation fluid 30, pressure indicator 13 generally will indicate a positive pressure throughout this process. As inner diameter fluid surface 10 (e.g., the surface of equilibrium fluid 11 in well bore 1) becomes approximately level with annular fluid surface 6 (e.g., the surface of cement composition 15 in annulus 5), the pressure indicated on pressure indicator 13 will approach zero. At this stage of the operation, equilibrium fluid 11 generally will completely fill the inner diameter of casing 3 and cement composition 15 generally will completely fill annulus 5, although, as noted previously herein, in certain embodiments of the present invention annulus 5 may be only partially filled with cement composition 15. Once the pressure indicated on pressure indicator 13 reads zero, cement composition 15 will have been circulated into position within annulus 5, with the leading edge of cement composition 15 adjacent to cement shoe 4, and pumping of cement composition 15 into annulus 5 generally will be halted. Thereafter, cement composition 15 generally will be allowed to reside in well bore 1 for a period of time sufficient to permit cement composition 15 to harden or solidify. Once cement composition 15 has solidified, a production pipe, or coiled tubing may be inserted into casing 3 to remove equilibrium fluid 11 from well bore 1. In certain embodiments of the present invention wherein it is desired to commence production, a completion brine may be placed in the well bore. In certain embodiments of the present invention, it may be desirable to place a drilling fluid in well bore 1 in preparation for drilling out casing shoe 4 and extending well bore 1 to a desired, deeper depth. For example, if casing 3 comprises a surface casing string, it may be desirable to drill out casing shoe 4, extend well bore 1 to a desired depth, and install additional strings of casing (e.g., intermediate casing and/or production casing).

In alternative embodiments of the present invention, equilibrium fluid 11 may be heavier, or lighter, than cement composition 15. To ensure that the pressure indicated by pressure indicator 13 reads zero when the leading edge of cement composition 15 reaches casing shoe 4 (thereby indicating that cement composition 15 has been circulated into position in annulus 5, and that pumping of cement composition 15 may be discontinued), the combined hydrostatic pressure of circulation fluid 30 initially present in well bore 1 and equilibrium fluid 11 should equal the hydrostatic pressure of the volume of cement composition 15 that is desired to be placed in annulus 5. In one embodiment of the present invention, equilibrium fluid 11 may have a heavier density than the density of cement composition 15. The required volume of equilibrium fluid 11 ($V_{ef11}$) first may be calculated according to the following equation:

$$V_{ef11}=V_{tot}(\rho_{cc15}-\rho_{cf30})/(\rho_{ef11}-\rho_{cf30}) \qquad \text{EQUATION 2}$$

where $V_{tot}$ is the interior volume of casing 3, $\rho_{cc15}$ is the density of cement composition 15, $\rho_{cf30}$ is the density of circulation fluid 30 in the well bore, and $\rho_{ef11}$ is the density of equilibrium fluid 11. As noted earlier, from Equation 1, $V_{tot}=\pi r^2 h$, where r is the inside radius of casing 3 and h is the height or length of casing 3. The following example illustrates how the required volume of equilibrium fluid ($V_{ef}$) is calculated.

EXAMPLE

Figure 3A:
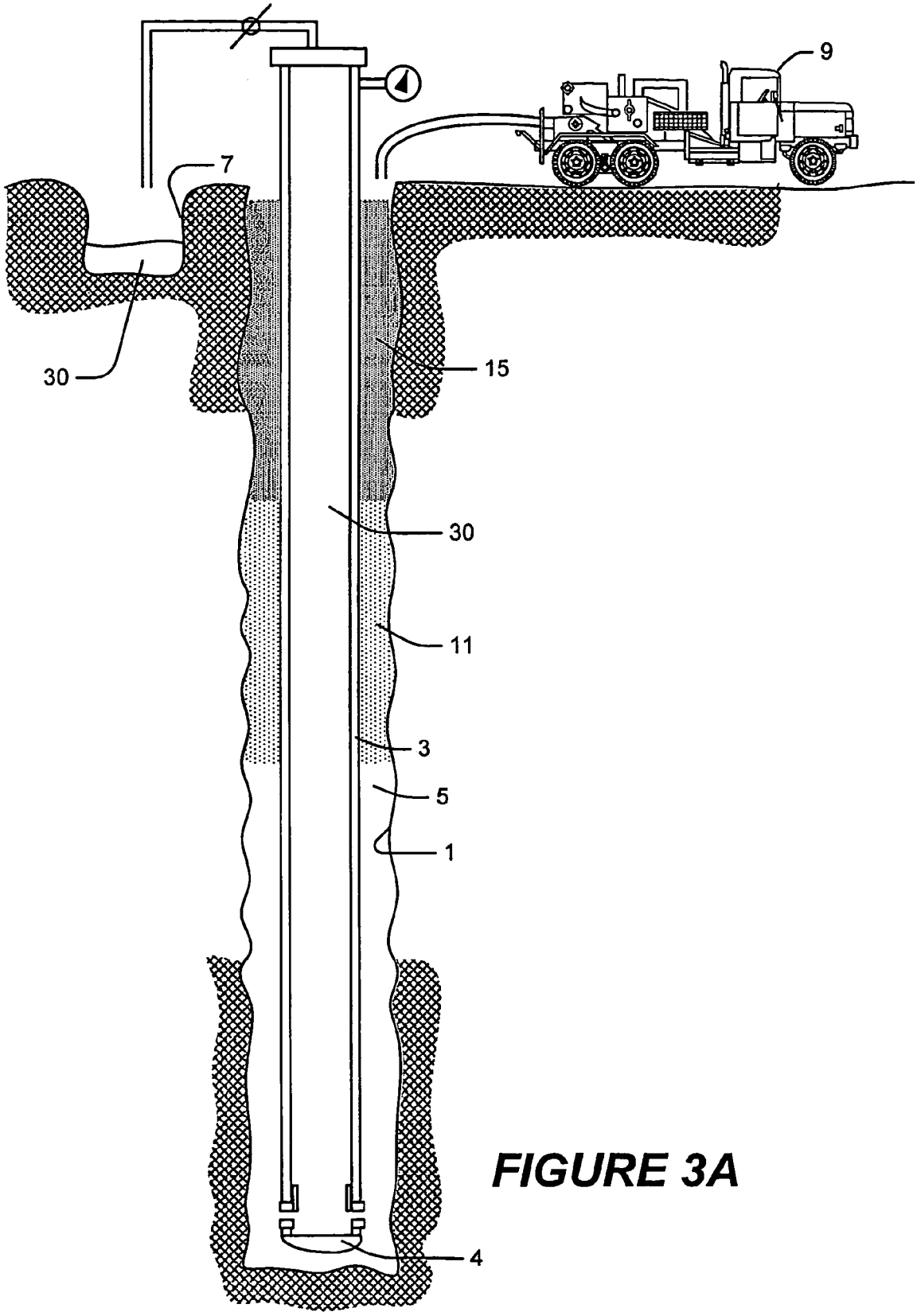
FIG. 3A illustrates a cross-sectional side view of a well bore and casing.

For example, assume that casing 3 has a length of 2,000 feet, and an internal diameter of 5 inches. Assume further that the desired length of casing 3 to be cemented is 2,000 feet. Accordingly, the radius of casing 3 will be 2.5 inches. Thus, $V_{tot}=H\ \pi r^2=[(2000\text{ feet})(3.1416)((2.5\text{ inch})^2/144)]/(5.614583)=48.6$ barrels. Further assume that the desired cement composition 15 has a density of 80 lbs/ft$^3$, that circulation fluid 30 has a density of 65 lbs/ft$^3$, and that the desired equilibrium fluid 11 has a density of 100 lbs/ft$^3$. Accordingly, applying EQUATION 2, $V_{ef}=V_{tot}(\rho_{cc15}-\rho_{cf30})/(\rho_{ef11}-\rho_{cf30})=48.6$ barrels (80 lbs/ft$^3$−65 lbs/ft$^3$)/(100 lbs/ft$^3$−65 lbs/ft$^3$)=20.8 barrels. Thus, in this example, 20.8 barrels of equilibrium fluid 11 would be required for use in order to ensure that the pressure displayed by pressure indicator 13 read zero when the leading edge of cement composition 15 reached casing shoe 4.

Where a relatively heavy equilibrium fluid 11 is used, it may be injected into annulus 5 immediately in front of cement composition 15. For example, FIG. 3A illustrates equilibrium fluid 11 being placed within annulus 5 in advance of cement composition 15. Because equilibrium fluid 11 and cement composition 15 are heavier than circulation fluid 30 in the inner diameter of casing 3, the fluids flow in a reverse-circulation direction. Further, the relatively heavier equilibrium fluid 11 and cement composition 15 induce an elevated pressure in the inner diameter of casing 3, as would be indicated on pressure indicator 13. Return valve 12 may be used to reduce or restrict the fluid flow through return line 8 to a desired rate. For example, return valve 12 may be partially closed to thereby modulate the rate of fluid flow therethrough. Alternatively, a choke manifold or an adjustable choke valve may be placed in return line 8 (e.g., generally downstream of return valve 12). The desired reduction or restriction in the flow rate of fluid through return line 8 may be determined by, inter alia, iteratively restricting the flow rate while monitoring the flow rate either visually or through an optional flowmeter.

Figure 3B:
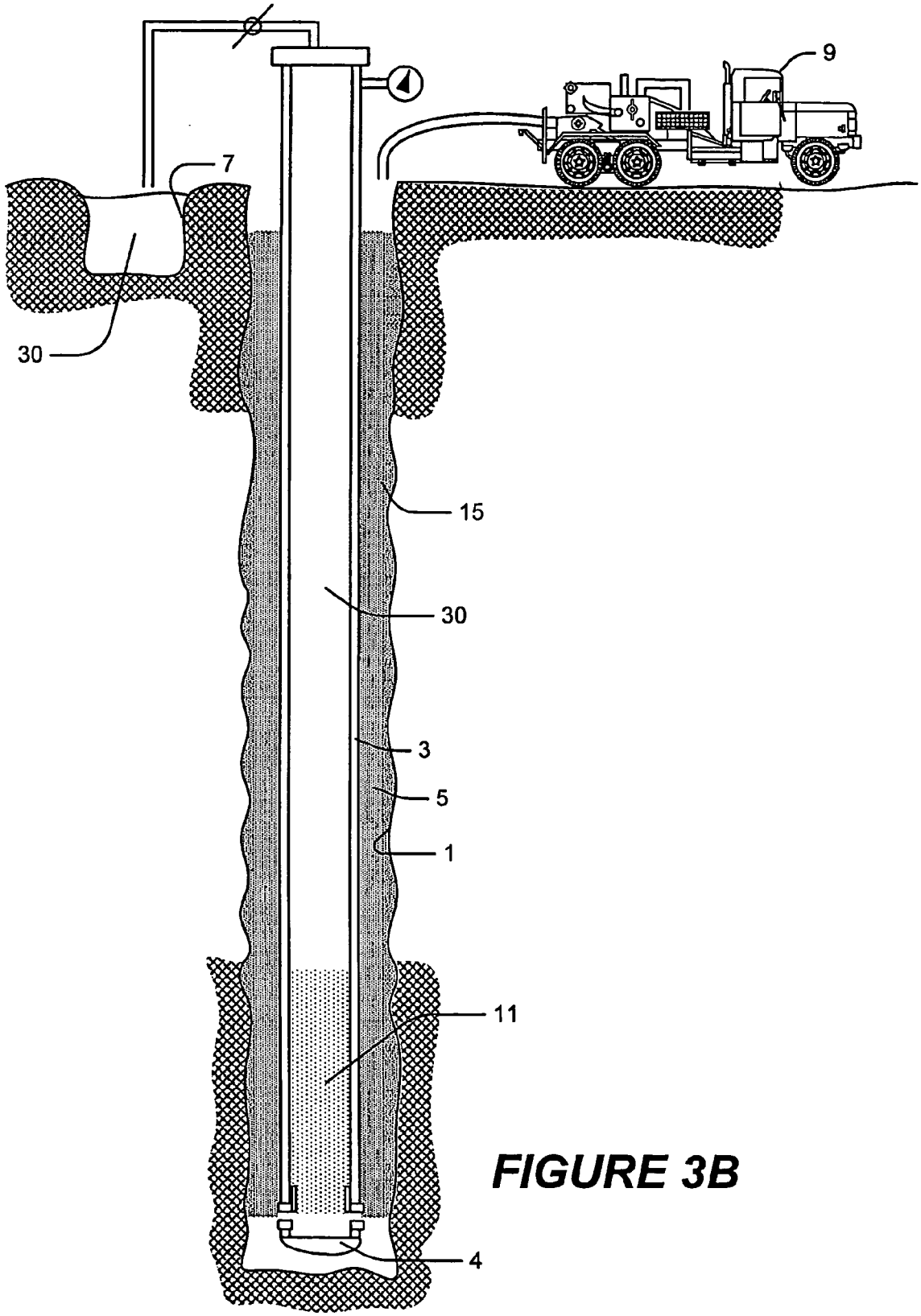
FIG. 3B illustrates a cross-sectional side view of the well bore and casing illustrated in FIG. 3A.

As shown in FIG. 3B, additional portions of cement composition 15 may be placed in annulus 5 behind equilibrium fluid 11 until annulus 5 is completely filled with cement composition 15. As equilibrium fluid 11 enters the inner diameter of casing 3 through casing shoe 4, the pressure indicated on pressure indicator 13 begins to decline. Once the hydrostatic fluid pressure generated by circulation fluid 30 and equilibrium fluid 11 in the inner diameter of casing 3 becomes approximately equal to the hydrostatic fluid pressure generated by cement composition 15 in annulus 5, the fluids will no longer flow through well bore 1, and will be in static equilibrium, as shown in FIG. 3B, because, in this embodiment, equilibrium fluid 11 is much heavier than cement composition 15.

Figure 4A:
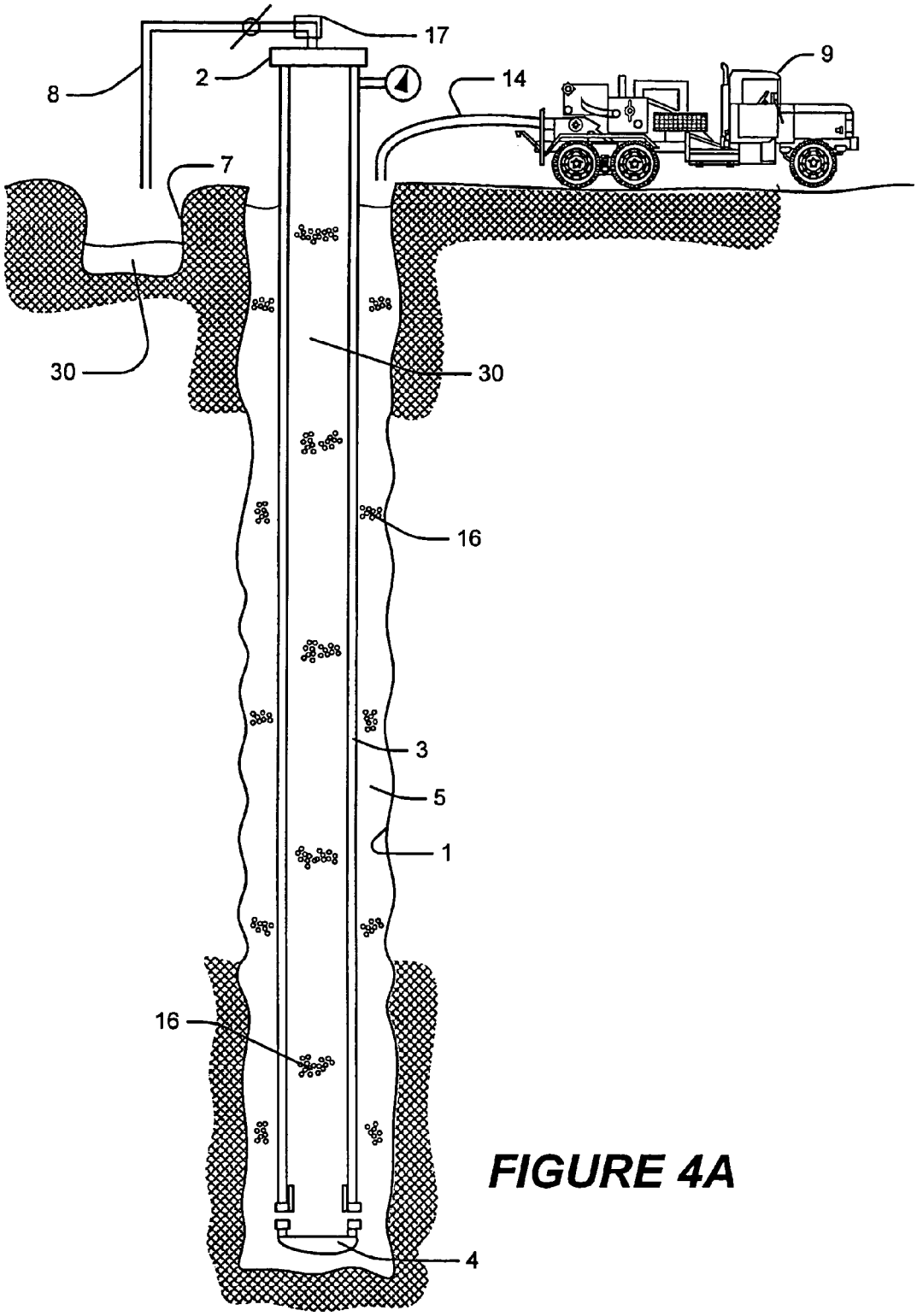
FIG. 4A illustrates a cross-sectional side view of a well bore and casing.
Figure 4B:
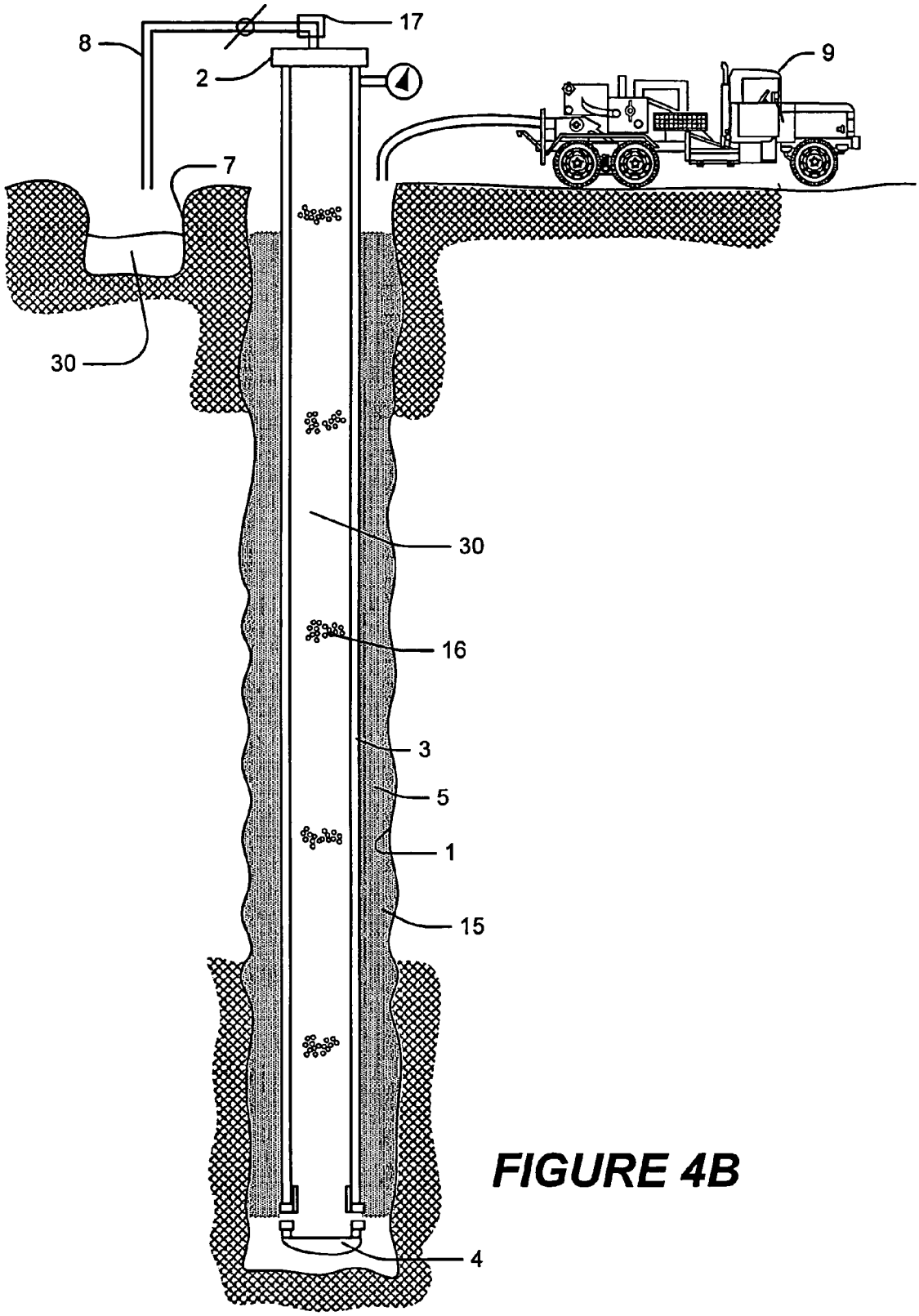
FIG. 4B illustrates a cross-sectional side view of the well bore and casing illustrated in FIG. 4A.

FIGS. 4A and 4B illustrate alternative embodiments of the present invention. As illustrated, casing 3 is inserted in well bore 1. Annulus 5 is defined between casing 3 and well bore 1. Casing 3 has casing shoe 4. Reservoir 7 and truck 9 are located near well bore 1. Supply line 14 is connected to truck 9 for pumping fluids into annulus 5.

As illustrated with reference to FIGS. 4A and 4B, in certain of these embodiments of the present invention, the mass flow rate and/or volumetric flow rate of returning circulation fluid 30 may be monitored with marker detector 17. In certain embodiments of the present invention, marker detector 17 may comprise, e.g., mass flow meters and/or borax detectors 17. Suitable mass flow meters are commercially available from, inter alia, MicroMotion Corporation of Boulder, Colo. Tag fluids 16 (e.g., marker pills comprising, inter alia, fibers, cellophane flakes, walnut shells, and the like) may be injected into circulation fluid 30 several barrels ahead of cement composition 15 so that the detection of tag fluids or marker pills 16 at the leading edge of circulation fluid 30 may signal to an operator the impending arrival of the leading edge of cement composition 15 at a desired location (e.g., the impending arrival of the leading edge of cement composition 15 at about the lowermost end of casing 3). Generally, the leading edge of cement composition 15 will not penetrate the inner diameter of casing 3.

As shown in FIG. 4A, tag fluids or marker pills 16 are injected into annulus 5 as circulation fluid 30 is pumped from truck 9, down through annulus 5, into the inner diameter of casing 3 through casing shoe 4, up through the inner diameter of casing 3 and through return line 8 into reservoir 7. Generally, circulation fluid 30 will have a greater density than the density of any formation fluids (not shown) or other fluids (not shown) that already may be present within annulus 5. In certain embodiments of the present invention, when cement composition 15 is flowed into annulus 5, a leading edge of cement composition 15 will be in fluid communication with a trailing edge of circulation fluid 30.

Marker detector 17 may be positioned in a variety of locations. In certain embodiments of the present invention, marker pills 16 are observed by marker detector 17 as they pass through return line 8. In certain embodiments of the present invention, marker detector 17 may be disposed such that it is in fluid communication with fluid passing through the inner diameter of casing 3. In certain embodiments of the present invention, marker detector 17 may be disposed such that it is in fluid communication with fluid passing through well head 2. In certain embodiments of the present invention, marker detector 17 may be disposed such that it is positioned in the inner diameter of casing 3 at about the mouth of well bore 1. In certain embodiments of the present invention, marker detector 17 may be disposed such that it is positioned in the inner diameter of casing 3, below the mouth of well bore 1. In certain embodiments of the present invention, marker detector 17 may be connected to a wireline (not shown) that is disposed within the inner diameter of casing 3, below the mouth of well bore 1. In certain embodiments of the present invention, marker detector 17 may be disposed such that it is positioned in the inner diameter of casing 3, at a depth within the upper 25% of the length of casing 3. In certain embodiments of the present invention, marker detector 17 may be disposed such that it is positioned in the inner diameter of casing 3, at a depth below about the upper 25% of the length of casing 3.

In certain embodiments of the present invention, more than one sample of tag fluids or marker pills 16 may be injected into annulus 5, and the volume of circulation fluid 30 injected between samples of tag fluids or marker pills 16 may be monitored.

In certain embodiments of the present invention wherein the inner volume of casing 3 is known, tag fluids or marker pills 16 may be injected into annulus 5 as circulation fluid 30 is pumped from truck 9, and, after flowing into annulus 5 a volume of circulation fluid 30 that is about equal to the inner volume of casing 3, cement composition 15 may be flowed into annulus 5. In certain of such embodiments, the arrival of tag fluids or marker pills 16 at marker detector 17 will signal the impending arrival of the leading edge of cement composition 15 at about the lowermost end of casing 3 (e.g., at about casing shoe 4), and will indicate that the flow of cement composition 15 into annulus 5 may be discontinued.

As shown in FIG. 4B, tag fluids or marker pills 16 facilitate the injection of the proper amount of cement composition 15 into annulus 5. Knowing the inner diameter volume of casing 3 and having observed the volume of circulation fluid 30 that had passed through well bore 1 when marker pills 16 were observed at marker detector 17 facilitates calculation of the volume of cement composition 15 to be pumped into annulus 5 to fill annulus 5 without permitting cement composition 15 to flow into casing 3. In certain optional embodiments of the present invention, an optional flow meter may be used that may comprise a totalizer that may identify the total volume of circulation fluid 30 that has passed through well bore 1 at the time when marker pills 16 are detected. Optionally, the total volume of circulation fluid 30 that has passed through well bore 1 at the time of detection of marker pills 16 may be estimated by monitoring the fluid level in reservoir 7, which may have gradations or other markings that may be useful in determining the fluid volume therein. In certain embodiments of the present invention, the use of more than one sample of tag fluids or marker pills 16 may facilitate improved accuracy in measuring, inter alia, the fluid volume of the inner diameter of casing 3, and the fluid volume of annulus 5. In certain embodiments of the present invention, once the fluid volume of annulus 5 has been measured accurately, a corresponding volume of cement composition 15 may be reverse circulated into annulus 5, as illustrated in FIG. 4B.

Accordingly, an example of a method of the present invention is a method of cementing casing in a well bore, comprising: inserting a casing into the well bore, the casing having an inner diameter and an outer surface, an annulus being defined between the outer surface of the casing and an inner wall of the well bore; flowing an equilibrium fluid into the well bore; flowing a cement composition into the well bore after flowing the equilibrium fluid into the well bore; permitting the pressure in the annulus to reach equilibrium with the pressure in the inner diameter of the casing, such that flow of cement composition into the well bore ceases; and permitting the cement composition to set in the well bore.

Another example of a method of the present invention is a method of cementing casing in a well bore, comprising: inserting a casing into the well bore, the casing having an inner diameter and an outer surface, an annulus being defined between the outer surface of the casing and an inner wall of the well bore; flowing an equilibrium fluid into the well bore; flowing a cement composition into the well bore after flowing the equilibrium fluid into the well bore; monitoring the pressure in the inner diameter of the casing; discontinuing the flow of cement composition into the well bore upon determining that the pressure in the inner diameter of the casing has reached a desired value; and permitting the cement composition to set in the well bore.

Another example of a method of the present invention is a method of cementing casing in a well bore, comprising: inserting casing into the well bore; flowing a circulation fluid into the well bore; flowing a marker into the well bore at a desired time during the flowing of the circulation fluid into the well bore; determining when the marker reaches a desired location; monitoring a volume of circulation fluid after flowing the marker into the well bore, and before determining when the marker reaches a desired location; determining a volume of cement composition to be flowed into the well bore; flowing the determined volume of cement composition into the well bore; and permitting the cement composition to set in the well bore.

Another example of a method of the present invention is a method of cementing casing in a well bore, comprising: inserting casing into the well bore; flowing a volume of circulation fluid, comprising a marker, into the well bore, the volume of circulation fluid being about equal to an inside volume of the casing; flowing a cement composition into the well bore after flowing the volume of circulation fluid; determining when the marker reaches a desired location; discontinuing flowing the cement composition into the well bore; and permitting the cement composition to set in the well bore.

An example of a system of the present invention is a system for cementing casing in a well bore comprising: a casing inserted into the well bore and defining an annulus therebetween; a cement composition for flowing into at least a portion of the annulus; and an equilibrium fluid that is positioned within the inner diameter of the casing and balances the static fluid pressures between the inner diameter of the casing and the annulus.

Another example of a system of the present invention is a system for cementing casing in a well bore comprising: a casing inserted into the well bore and defining an annulus therebetween, the casing having an inner diameter; a circulation fluid for flowing into the well bore, the circulation fluid having a leading edge that comprises a marker, and having a trailing edge, wherein the flow of the circulation fluid and marker into the well bore facilitates determination of a volume of cement composition sufficient to fill a desired portion of the annulus; a cement composition for flowing into at least a portion of the annulus, the cement composition having a leading edge in fluid communication with the trailing edge of the circulation fluid; and a marker detector in fluid communication with fluid passing through the inner diameter of the casing.

Therefore, the present invention is well adapted to carry out the objects and attain the ends and advantages mentioned as well as those which are inherent therein. While the invention has been depicted, and described by reference to embodiments of the present invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the present invention are exemplary only, and are not exhaustive of the scope of the present invention. Consequently, the invention is intended to be limited only by the spirit and scope of the appended claims, giving full cognizance to equivalents in all respects.

What is claimed is:

1. A method of cementing casing in a well bore, comprising:

inserting a casing into the well bore, the casing having an inner diameter and an outer surface, an annulus being defined between the outer surface of the casing and an inner wall of the well bore;

flowing an equilibrium fluid into the well bore;

flowing a cement composition into the well bore after flowing the equilibrium fluid into the well bore;

permitting the pressure in the annulus to reach equilibrium with the pressure in the inner diameter of the casing, such that flow of cement composition into the well bore ceases and the cement composition does not penetrate the inner diameter of the casing; and permitting the cement composition to set in the well bore.

2. The method of claim 1 wherein the casing comprises a well head and a casing inner diameter pressure indicator.

3. The method of claim 2 further comprising determining from the casing inner diameter pressure indicator when the casing inner diameter pressure has reached a desired value.

4. The method of claim 3 wherein the desired value of the casing inner diameter pressure is about zero.

5. The method of claim 4 wherein the well bore comprises a first fluid prior to flowing an equilibrium fluid into the well bore, wherein the cement composition has a leading edge, and wherein when the leading edge of the cement composition is about adjacent to a lowermost end of the casing, the static fluid pressure of a fluid column in the annulus is about equal to the static fluid pressure of a fluid column in the inner diameter of the casing.

6. The method of claim 1 wherein flowing an equilibrium fluid into the well bore comprises flowing the equilibrium fluid into the well bore in a reverse-circulation direction.

7. The method of claim 1 wherein flowing a cement composition into the well bore after flowing the equilibrium fluid comprises flowing the cement composition into the well bore in a reverse-circulation direction.

8. The method of claim 1 wherein the cement composition has a leading edge, and wherein the leading edge of the cement composition is about adjacent a lowermost end of the casing when the flow of cement composition into the well bore ceases.

9. The method of claim 6 wherein the leading edge of the cement composition does not penetrate the inner diameter of the casing.

10. The method of claim 1 wherein the density of the equilibrium fluid is about equal to the density of the cement composition.

11. The method of claim 1 wherein the cement composition has a leading edge, and wherein the equilibrium fluid and the cement composition each have a density such that when the leading edge of the cement composition is about adjacent the lowermost end of the casing, the static fluid pressure of a fluid column in the annulus is about equal to a static fluid pressure of a fluid column in the casing inner diameter.

12. The method of claim 1 wherein the equilibrium fluid comprises a drilling fluid.

13. The method of claim 1 wherein the equilibrium fluid comprises a spacer fluid.

14. The method of claim 1 wherein the density of the equilibrium fluid is greater than the density of the cement composition.

15. The method of claim 14 wherein the well bore comprises a first fluid prior to flowing an equilibrium fluid into the well bore, wherein the cement composition has a leading edge, and wherein when the leading edge of the cement composition is about adjacent to a lowermost end of the casing, the static fluid pressure of a fluid column in the annulus is about equal to the static fluid pressure of a fluid column in the inner diameter of the casing.

16. The method of claim 1 wherein the density of the equilibrium fluid is less than the density of the cement composition.

17. The method of claim 1 further comprising calculating a desired volume of equilibrium fluid.

18. The method of claim 17 wherein calculating a desired volume of equilibrium fluid is performed before flowing an equilibrium fluid into the well bore.

19. The method of claim 17 wherein the casing has an interior volume, and wherein calculating a desired volume of equilibrium fluid to be injected comprises equating the desired volume of equilibrium fluid to the interior volume of the casing.

20. The method of claim 19 wherein a first fluid is present in the well bore prior to flowing an equilibrium fluid into the well bore, and wherein calculating the desired volume of equilibrium fluid to be injected comprises:

determining the difference in densities of the cement composition and the first fluid by subtracting the density of the first fluid from the density of the cement composition;

determining a product by multiplying the inner volume of the casing by the difference in densities of the cement composition and the first fluid;

determining the difference in densities of the equilibrium fluid and the first fluid by subtracting the density of the first fluid from the density of the equilibrium fluid; and dividing the product by the difference in densities of the equilibrium fluid and the first fluid.

21. The method of claim 1 further comprising inserting coiled tubing into the inner diameter of the casing and circulating equilibrium fluid out of the inner diameter to the surface.

22. A method of cementing casing in a well bore, comprising:

inserting a casing into the well bore, the casing having an inner diameter and an outer surface, an annulus being defined between the outer surface of the casing and an inner wall of the well bore;

flowing an equilibrium fluid into the well bore;

flowing a cement composition into the well bore after flowing the equilibrium fluid into the well bore;

monitoring the pressure in the inner diameter of the casing;

discontinuing the flow of cement composition into the well bore upon determining that the pressure in the inner diameter of the casing has reached a desired value, wherein the cement composition does not penetrate the inner diameter of the casing; and permitting the cement composition to set in the well bore.

23. The method of claim 22 wherein the casing comprises a well head, and a casing inner diameter pressure indicator.

24. The method of claim 23 further comprising determining from the casing inner diameter pressure indicator when the pressure in the inner diameter of the casing has reached a desired value.

25. The method of claim 23 wherein the desired value of the well bore pressure is about zero.

26. The method of claim 25 wherein the well bore comprises a first fluid prior to flowing an equilibrium fluid into the well bore, wherein the cement composition has a leading edge, and wherein when the leading edge of the cement composition is about adjacent to a lowermost end of the casing, the static fluid pressure of a fluid column in the annulus is about equal to the static fluid pressure of a fluid column in the inner diameter of the casing.

27. The method of claim 22 wherein flowing an equilibrium fluid into the well bore comprises flowing the equilibrium fluid into the well bore in a reverse-circulation direction.

28. The method of claim 22 wherein flowing a cement composition into the well bore after flowing the equilibrium fluid comprises flowing the cement composition into the well bore in a reverse-circulation direction.

29. The method of claim 22 wherein the cement composition has a leading edge, and wherein the leading edge of the cement composition is about adjacent a lowermost end of the casing when the flow of cement composition into the well bore is discontinued.

30. The method of claim 29 wherein the leading edge of the cement composition does not penetrate the inner diameter of the casing.

31. The method of claim 22 wherein the density of the equilibrium fluid is about equal to the density of the cement composition.

32. The method of claim 22 wherein the cement composition has a leading edge, and wherein the equilibrium fluid and the cement composition each have a density such that when the leading edge of the cement composition is about adjacent a lowermost end of the casing, the static fluid pressure of a fluid column in the annulus is about equal to the static fluid pressure of a fluid column in the casing inner diameter.

33. The method of claim 22 wherein the equilibrium fluid comprises a drilling fluid.

34. The method of claim 22 wherein the equilibrium fluid comprises a spacer fluid.

35. The method of claim 22 wherein the density of the equilibrium fluid is greater than the density of the cement composition.

36. The method of claim 35 wherein the well bore comprises a first fluid prior to flowing an equilibrium fluid into the well bore, wherein the cement composition has a leading edge, and wherein when the leading edge of the cement composition is about adjacent to a lowermost end of the casing, the static fluid pressure of a fluid column in the annulus is about equal to the static fluid pressure of a fluid column in the inner diameter of the casing.

37. The method of claim 22 wherein the density of the equilibrium fluid is less than the density of the cement composition.

38. The method of claim 22 further comprising calculating a desired volume of equilibrium fluid.

39. The method of claim 38 wherein calculating a desired volume of equilibrium fluid is performed before flowing an equilibrium fluid into the well bore.

40. The method of claim 39 wherein the casing has an interior volume, and wherein calculating a desired volume of equilibrium fluid to be injected comprises equating the desired volume of equilibrium fluid to the interior volume of the casing.

41. The method of claim 40 wherein a first fluid is present in the well bore prior to flowing an equilibrium fluid into the well bore, and wherein calculating the desired volume of equilibrium fluid to be injected comprises:

determining the difference in densities of the cement composition and the first fluid by subtracting the density of the first fluid from the density of the cement composition;

determining a product by multiplying the inner volume of the casing by the difference in densities of the cement composition and the first fluid;

determining the difference in densities of the equilibrium fluid and the first fluid by subtracting the density of the first fluid from the density of the equilibrium fluid; and dividing the product by the difference in densities of the equilibrium fluid and the first fluid.

42. The method of claim 22 further comprising inserting coiled tubing into the inner diameter of the casing and circulating equilibrium fluid out of the inner diameter to the surface.

43. A method of cementing casing in a well bore, comprising:

inserting a casing into the well bore, the casing having an inner diameter and an outer surface, an annulus being defined between the outer surface of the casing and an inner wall of the well bore;

flowing an equilibrium fluid into the well bore;

flowing a cement composition into the well bore after flowing the equilibrium fluid into the well bore;

permitting pressure in the inner diameter of the casing to reach a desired value, such that flow of cement composition into the well bore ceases and the cement composition does not penetrate the inner diameter of the casing; and permitting the cement composition to set in the well bore.

44. The method of claim 43 wherein the casing comprises a well head, and a casing inner diameter pressure indicator.

45. The method of claim 44 further comprising determining from the casing inner diameter pressure indicator when the pressure in the inner diameter of the casing has reached the desired value.

46. The method of claim 43 wherein flowing the equilibrium fluid into the well bore comprises flowing the equilibrium fluid into the well bore in a reverse-circulation direction.

47. The method of claim 43 wherein flowing the cement composition into the well bore after flowing the equilibrium fluid comprises flowing the cement composition into the well bore in a reverse-circulation direction.

48. The method of claim 43 wherein the cement composition has a leading edge, and wherein the leading edge of the cement composition is about adjacent to a lowermost end of the casing when the flow of cement composition into the well bore is permitted to cease and wherein the leading edge of the cement composition does not penetrate the inner diameter of the casing.

49. The method of claim 43 wherein the desired value of the well bore pressure is about zero.

50. The method of claim 43 further comprising calculating a desired volume of equilibrium fluid.

51. The method of claim 50 wherein calculating the desired volume of equilibrium fluid is performed before flowing an equilibrium fluid into the well bore.

52. The method of claim 51 wherein the casing has an interior volume, and wherein calculating the desired volume of equilibrium fluid to be injected comprises equating the desired volume of equilibrium fluid to the interior volume of the casing.

53. The method of claim 52 wherein a first fluid is present in the well bore prior to flowing the equilibrium fluid into the well bore, and wherein calculating the desired volume of equilibrium fluid to be injected comprises:

determining the difference in densities of the cement composition and the first fluid by subtracting the density of the first fluid from the density of the cement composition;

determining a product by multiplying the inner volume of the casing by the difference in densities of the cement composition and the first fluid;

determining the difference in densities of the equilibrium fluid and the first fluid by subtracting the density of the first fluid from the density of the equilibrium fluid; and dividing the product by the difference in densities of the equilibrium fluid and the first fluid.

* * * * *